United States Patent [19]

Kapetanakos

[11] 4,293,794

[45] Oct. 6, 1981

[54] GENERATION OF INTENSE, HIGH-ENERGY ION PULSES BY MAGNETIC COMPRESSION OF ION RINGS

[76] Inventor: Christos A. Kapetanakos, 6101 Overlea Rd., Bethesda, Md. 20016

[21] Appl. No.: 136,227

[22] Filed: Apr. 1, 1980

[51] Int. Cl.[3] ..... H01J 3/04

[52] U.S. Cl. ..... 315/111.81; 313/230; 315/111.41; 315/344; 376/106; 376/140

[58] Field of Search ..... 315/111.4, 111.8, 344, 315/348; 250/396 ML, 423 R; 328/228, 233; 313/153, 154, 230, 231, 362

[56] References Cited

U.S. PATENT DOCUMENTS 4,156,832 5/1979 Kistemaker et al. ..... 315/111.4
4,243,916 1/1981 Leboutet et al. ..... 315/111.8

OTHER PUBLICATIONS

Graybill et al., *Techniques for the Study of Self-Focusing Electron Streams,* Proceedings of the 8th Annual Electron & Laser Beam Symposium, Apr. 6–8, 1966 pp. 465–486.

*Primary Examiner*—Eugene R. La Roche
*Attorney, Agent, or Firm*—R. S. Sciascia; William T. Ellis; Vincent J. Ranucci

[57] ABSTRACT

A system based on the magnetic compression of ion rings, for generating intense (high-current), high-energy ion pulses that are guided to a target without a metallic wall or an applied external magnetic field includes a vacuum chamber; an inverse reflex tetrode for producing a hollow ion beam within the chamber; magnetic coils for producing a magnetic field, $B_o$, along the axis of the chamber; a disc that sharpens a magnetic cusp for providing a rotational velocity to the beam and causing the beam to rotate; first and second gate coils for producing fast-rising magnetic field gates, the gates being spaced apart, each gate modifying a corresponding magnetic mirror peak (near and far peaks) for trapping or extracting the ions from the magnetic mirror, the ions forming a ring or layer having rotational energy; a metal liner for generating by magnetic flux compression a high, time-varying magnetic field, the time-varying magnetic field progressively increasing the kinetic energy of the ions, the magnetic field from the second gate coil decreasing the far mirror peak at the end of the compression for extracting the trapped rotating ions from the confining mirror; and a disc that sharpens a magnetic half-cusp for increasing the translational velocity of the ion beam. The system utilizes the self-magnetic field of the rotating, propagating ion beam to prevent the beam from expanding radially upon extraction.

13 Claims, 4 Drawing Figures

GENERATION OF INTENSE, HIGH-ENERGY ION PULSES BY MAGNETIC COMPRESSION OF ION RINGS

BACKGROUND OF THE INVENTION

This invention relates generally to the generation of intense, high-energy ion pulses and more particularly to the extraction of magnetically compressed ion rings without the use of metallic walls or an external magnetic field to guide the ions.

No means exists for extracting a compressed ion ring and guiding a pulse, for example, to a target, without metallic walls which surround the ion pulse or an external magnetic field. Such requirements are disadvantageous since, for example, in systems which require a large separation between an ion accelerator and the target, neither metallic walls nor an external magnetic field is suitable for guiding an ion beam to the target.

The acceleration of ions by magnetic compression of ion rings has been treated by several authors:

(a) H. H. Fleischmann, Proc. of Electr. and Electromagnetic Conf. of Plasmas, NY (1974); (b) R. N. Sudan and E. Ott, Phys. Rev. Letts. 33, 355 (1974);
(c) E. S. Weibel, Phys. of Fluids 20, 1195 (1977);
(d) R. V. Lovelace, *Kinetic Theory of Ion Ring Compression* (unpublished);
(e) P. Sprangle and C. A. Kapetanakos, J. Appl. Phys. 49, 1 (1978); and
(f) R. N. Sudan, Phys. Rev. Lett. 41, 476 (1978).

However, with the exception of reference (f), the references have not considered the extraction of the ring after compression. In fact, extraction is irrelevant to references (a) to (d) because their objective is the use of ion rings for the magnetic confinement of plasmas in fusion reactors. Reference (e) discloses the non-adiabatic compression of weak rings. Reference (f) having inertial fusion as its objective, discusses the extraction of the ring after compression. However, in Sudan's scheme, the image currents on the wall of a tube that surrounds the ring provide a radial equilibrium during propagation of the ring from the compression region to the target. The guide tube is destroyed and must be replaced in each shot.

SUMMARY OF THE INVENTION

It is the general purpose and object of the present invention to generate high-energy, high-current ion pulses.

Another object is to extract and direct the ions, for example, to a target, without a guiding means such as a guide-tube or an applied external magnetic field.

These and other objects of the present invention are accomplished by forming a rotating ion ring; compressing the ion ring and thereby increasing the energy of the ions; extracting and propagating the ions; and utilizing the self-magnetic field of the rotating, propagating ion beam for preventing the beam from expanding upon extraction.

The novel feature of the present invention is the interrelation of magnetic fields with a hollow beam of ions for forming a rotating ring of ions, and for transferring some rotational energy of the ions to translational energy, the self-magnetic field of the ion beam providing an equilibrium to the beam which maintains the propagation of the non-radially expanding beam.

The advantage of the present invention over the prior art is that it does not require an external applied magnetic field or a tube for guiding the ion pulse from an accelerator to a target.

Other objects and advantages of the invention will become apparent from the following detailed description of the invention when considered in conjunction with the accompanying drawing wherein:

DETAILED DESCRIPTION OF THE INVENTION

Figure 1:
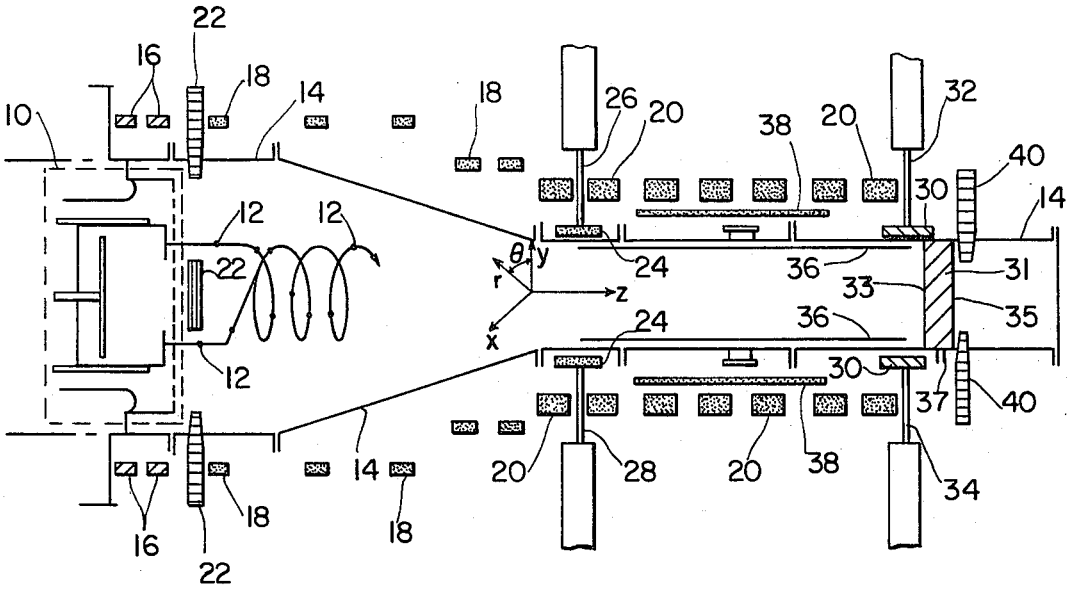
FIG. 1 is a schematic illustration of an embodiment of the present invention.
Figure 2:
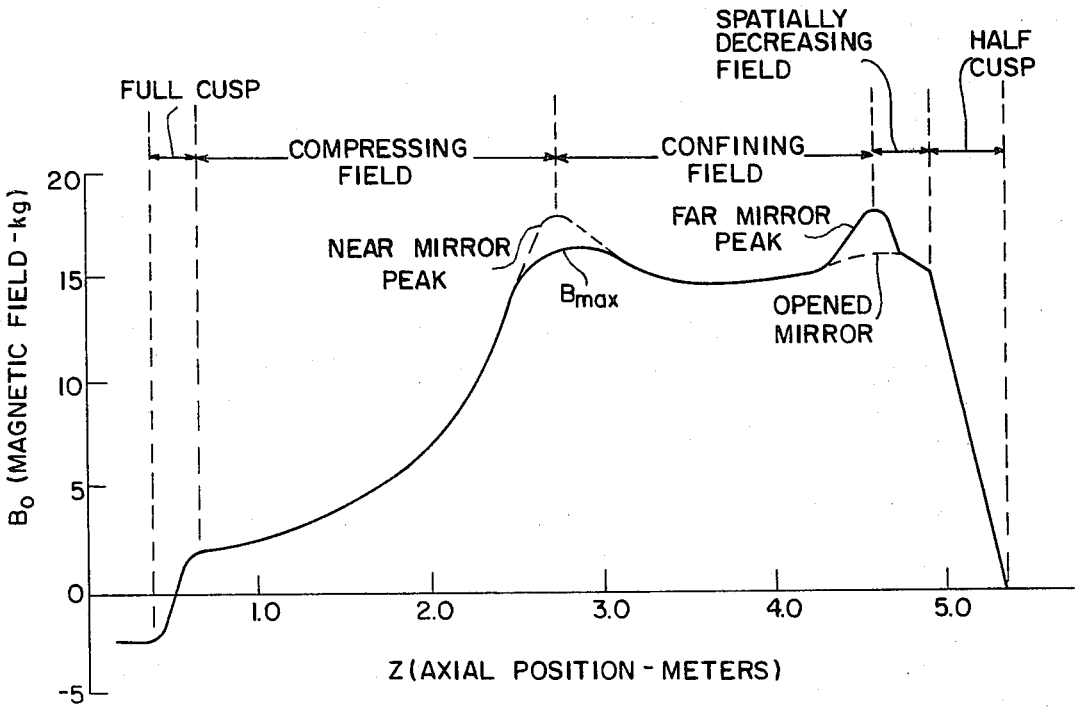
FIG. 2 is a graph illustrating the amplitude of the total system magnetic field with the axial distance of the system relative to the illustration shown in FIG. 1.

Referring now to the drawing, wherein like reference characters designate like or corresponding parts throughout the views, FIG. 1 shows a low-inductance inverse coaxial reflex tetrode (IRT) 10 for generating a hollow, thin beam of ions 12 having an energy level of approximately 2 megavolts (MeV). The energy level is a function of the application of the beam, i.e., larger levels for use as a weapons system and smaller levels for pellet irradiation. The IRT 10 is enclosed within a vacuum chamber 14 in which a vacuum approximately below $10^{-5}$ Torr is maintained. First, second, and third magnetic coils 16, 18, and 20, respectively, surround the vacuum chamber 14 for producing a magnetic field, $B_o$, having an amplitude which varies, as shown in FIG. 2, along the axis of the chamber and having radial, $B_r$, and axial, $B_z$, components. Any suitable means for forming the magnetic field may be utilized. As an example, the magnetic coils 16, 18, and 20 are spaced as shown in FIG. 1. Coils 16 and 18 have the same cross-sectional area but current in coil 16 flows in a direction opposite to the direction of the current in coil 18. Coil 20 has a larger cross-sectional area than coils 16 and 18. The current in coil 20 flows in the same direction as that of the current in coil 18.

A disc 22, typically made from a high-permeability ferromagnetic material and having a concentric, toroidal opening, lies in a plane transverse to the axis of the chamber 14. The disc 22 is adjacent to the IRT 10 and between coils 16 and 18. The disc 22 sharpens the magnetic cusp that is formed from coils 16 and 18. Ions 12 from the IRT 10 pass through the opening of the disc 22 as shown in FIG. 1.

A first gate coil 24, which is typically coupled to transmission lines 26 and 28, and a second gate coil 30, which is typically coupled to transmission lines 32 and 34, surround the chamber 14. The transmission lines are typically fed by low-inductance capacitors (not shown). Current in the first gate coil 24 flows in the same direction as that of magnetic coils 18 and 20, whereas current in the second gate coil 30 flows in the opposite direction. An imploding liner 36, formed from a suitable material such as metal, lines the inner wall of the chamber 14 and extends in length approximately from the center of the first gate coil 24 to the center of the second gate coil 30.

A compressing magnetic coil 38 surrounds the chamber 14 and is spaced between third magnetic coil 20 and the outer wall of the chamber. The compressing coil is centered about the imploding liner 36. A neutral gas 31, such as nitrogen, is located in a portion of the chamber as shown in FIG. 1. The gas is confined by foils 33 and 35. The foils are formed from any suitable material, such as plastic, which confines the gas but allows the ions to pass through. The gas may be injected through an inlet 37. A toroidal disc 40, typically made from a ferromagnetic material, is coaxially transverse to the axis of the chamber. The toroidal disc is located between the gas 31 and the end of the chamber 14 from which chamber the ions 12 exit. The disc 40 sharpens a magnetic half-cusp.

In operation, a hollow, thin beam of ions approximately 50-70 nsec duration, is generated by the IRT 10. The motion of typical ions 12 is shown in FIGS. 1 and 2. The pulse duration may be shorter or longer. If a longer pulse duration is used, the axial length of the system must be longer. The ions 12 of the beam pass through a full magnetic cusp ($B_z+B_r$) which is formed by first and second magnetic coils, 16 and 18, respectively, and the disc 22. The disc 22 increases the slope of the magnetic field as the field passes from negative to positive, as shown in FIG. 2. The ions have a translational velocity, $v_z$, and are exposed to the radial magnetic field component $B_r$ of the total magnetic field, $B_o$, (where $\vec{B_o}=\vec{B_r}+\vec{B_z}$). As a result of the q ($v_z \times B_r$) force, where q=the charge of an ion, the ions obtain rotational velocity, $v_\theta$, and begin to rotate. The rotational velocity, $v_\theta$, of the ions is further enhanced at the expense of its translational velocity, $v_z$, by a static compressing magnetic field ($B_r+B_z$). The maximum value, $B_{max}$, of the compressing field is such that the ions which are located at the outer edge of the beam arrive at $B_{max}$ with zero translational velocity, $v_z$.

Figure 3:
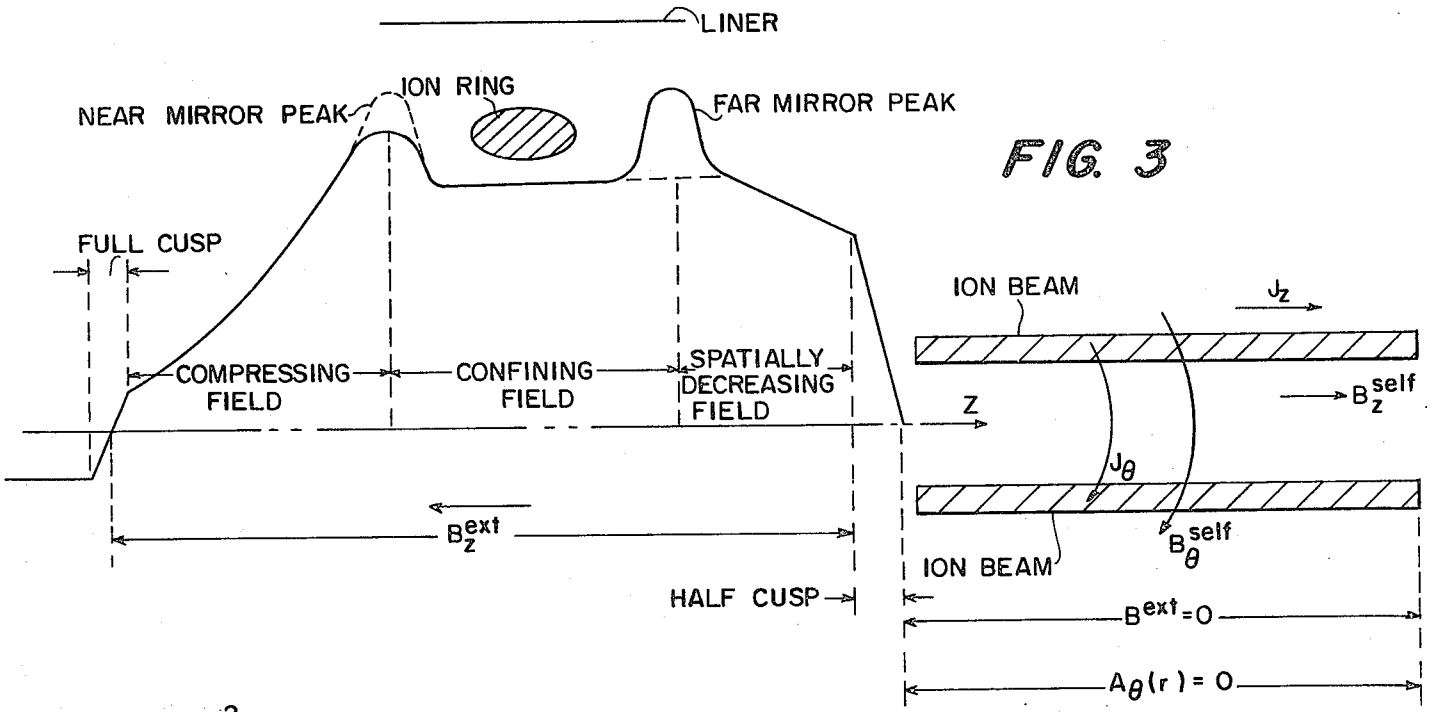
FIG. 3 is a graph, similar to that shown in FIG. 2, illustrating an ion ring trapped inside a magnetic mirror, and a rotating, propagating ion beam that is formed after the extraction of the ring from the confining magnetic mirror.

The ion ring is formed by trapping the ion pulse in a magnetic mirror, that is, between a near mirror peak and a far mirror peak, as shown in FIGS. 2 and 3. The near mirror peak includes $B_{max}$, but is increased by adding to $B_{max}$ the magnetic field which is produced by first gate coil 24 of FIG. 1. The far mirror peak is produced by magnetic coils 20. The far mirror peak may be reduced, thus opening the mirror, by adding the magnetic field which is produced by second gate coil 30 of FIG. 1 to the field that is produced by magnetic coils 20. Since the current in second gate coil 30 is of opposite polarity to the current in magnetic coils 20, the magnetic field from second gate coil 30 reduces the magnetic field from magnetic coils 20 and effectively opens the far mirror peak.

The rotational energy of the ion ring is enhanced, while the ring is trapped between the magnetic mirror peaks, by increasing the confining magnetic field with time and transferring energy from the confining magnetic field to the ions. The confining magnetic field is increased by magnetic flux compression (flux=$B_cS$, where $B_c$ is the confining magnetic field, and S is the area (in the x-y plane shown in FIG. 1) covered by $B_c$) which is a constant. Therefore, as the area S is decreased, $B_c$ is increased. For adiabatic compression, that is, for a slowly increasing confining magnetic field, an appreciable saving of magnetic energy is realized by using an imploding liner 36 to compress the ion ring. Compressing coil 38, as shown in FIG. 1, is an example of a means for compressing the liner 36. The compressing coil 38 produces a time-varying magnetic field, B (t), which compresses the liner 36 and the ion ring.

After compression, the ion ring is extracted from the confining magnetic field by opening the far mirror peak as previously mentioned. Initially, the ring expands adiabatically in a spatially decreasing magnetic field. The ions pass through the gas 31 which separates the ions from any electrons which may be intermixed with the ions. When the ratio $v_{\parallel}/v_{\perp}$, where $v_{\parallel}$ and $v_{\perp}$ are the velocities of the ring parallel and perpendicular to the magnetic field lines, respectively, acquires a desirable value, the ring passes through a sharp half cusp that further increases $v_{\perp}$ at the expense of $v_{\parallel}$. A desirable value of the ratio $v_{\parallel}/v_{\perp}$ is related to a desirable radius of the ion beam, that is, a large radius for applications such as a weapons system, or a small radius for pellet irradiation.

The extraction of the ion ring after compression and the equilibrium of the ring upon extraction is discussed by C. A. Kapetanakos in "Generation of High - Energy Current Ion pulses by Magnetic Compression of Ion Rings", NRL Memorandum Report 4093, National Technical Information Service Order Number ADA 076200, herein incorporated by reference.

In the single particle approximation, when an ion is compressed adiabatically by a time-increasing magnetic field, the energy of the ions E(t), the major radius of the ring R(t) and the particle current I(t) are $$E(t) = \frac{2E(o)}{\gamma(t)+1}[B(t)/B(o)]$$

$$R(t) = R(o)[B(o)/B(t)]^{\frac{1}{2}},$$

and $$I(t) = \frac{I(o)}{\gamma(t)}[B(t)/B(o)],$$

where E(o), R(o), I(o) and B(o) are the initial values of energy, major ring radius, particle current and magnetic field respectively, B(t) is the value of the magnetic field at time t and $\gamma(t)$ is the relativistic factor.

Figure 4:
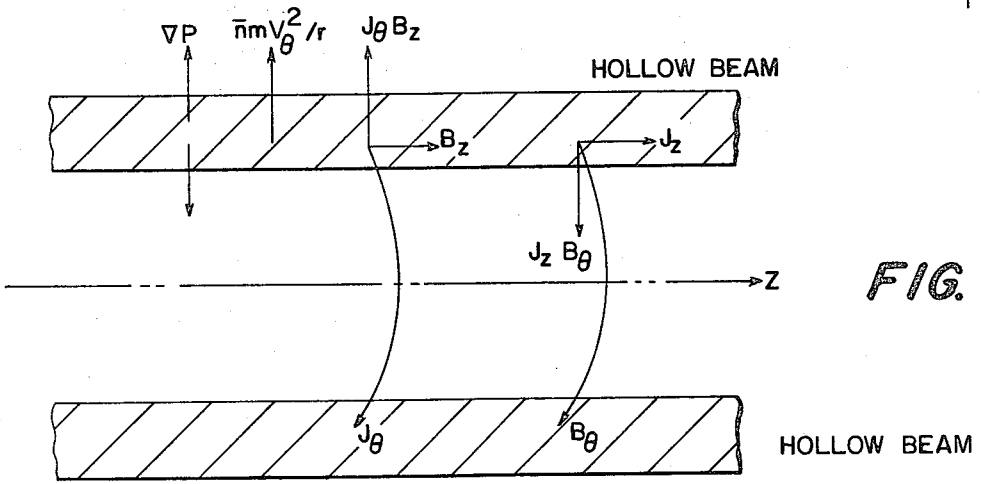
FIG. 4 shows the beam after extraction, as illustrated in FIG. 3, and shows the forces which act on the beam during propagation.

Although the radius of the beam remains virtually unchanged as the beam passes through the sharp half cusp, the conservation of canonical angular momentum, $P_\theta$, [$P_\theta$ is a constant of the motion, and in the present case $$P_\theta = mrv_\theta + \frac{qr\,A_\theta}{c},$$

where m is the mass of an ion, r is the radial position of an ion in the beam, c is the speed of light, and $A_\theta$ is the magnetic vector potential, that is, $A_\theta$ describes the magnetic field ($B_r$, $B_z$)], requires a rapid expansion of the beam (an increase in r) when $A_\theta$ (r) is zero. This expansion is required because, for $P_\theta$ being a constant and being equal to $$mrv_\theta + \frac{qrA_\theta}{c},$$

the radius r must increase to maintain the value of $P_\theta$ (m and $v_\theta$ remaining constant) when the $QrA_\theta/c$ factor becomes zero. However, for intense rotating beams $A_\theta$ (r)$\neq$o on the right side of the half cusp, as shown in FIG. 3, because $$A_\theta(r)=A_\theta^{ext}(r)+A_\theta^{self}(r),$$

where $A_\theta^{ext}(r)$ is due to the externally applied field, and $A_\theta^{self}(r)$ is due to the azimuthal current of the beam, and $A_\theta^{self}(r)\neq o$ at that point, although $A_\theta^{ext}(r)$ is zero there. Therefore, $P_\theta$ can be conserved without an appreciable increase of r, even in the absence of an external field, provided that $A_\theta^{self}(r)\neq o$. However, conservation of $P_\theta$ does not insure the equilibrium (non-expansion) of the beam. For the equilibrium to exist, a negative force, ($J_zB_\theta$, shown in FIG. 4) which is provided by a self-field, $B_\theta$, of the beam, is required. The balance of forces which are acting on the beam after extraction is shown in FIG. 4. The inward force, $J_zB_\theta$, balances the outward forces which comprise $J_\theta B_z, \nabla P$, and $\bar{n}m\ v_\theta^2/r$, where $J_z$ and $J_\theta$ are the current densities of the rotating ion beam, $B_z$ and $B_\theta$ are the self-magnetic fields of the beam, $\nabla P$ is the force produced by the pressure associated with the beam (ionized gas), and $\bar{n}m\ v_\theta^2/r$ is the centrifugal force on the beam, $\bar{n}$ being a constant.

To summarize the operation, the IRT 10 produces an ion pulse. The ions 12 pass through the disc 22 and the full magnetic cusp. The cusp is formed essentially by first and second magnetic coils, 16 and 18, respectively, and the disc 22. The disc increases the slope of the cusp and the cusp causes the ions to rotate. The ions propagate through the compressing magnetic field which is formed essentially by second and third magnetic coils, 18 and 20, respectively. The rotational energy of the ions increases at the expense of the translational energy of the ions as the ions pass through the compressing magnetic field. After leaving the compressing magnetic field the ions enter the confining magnetic field which is formed essentially by third magnetic coils 20 and the first gate coil 24. The confining magnetic field exists in the near mirror peak region, the far mirror peak region and the region between the peaks. The peaks form a magnetic mirror. The first gate coil increases the amplitude of $B_{max}$, thus strengthening the near mirror peak. The ions become trapped in the magnetic mirror between the peaks, and while entrapped, the rotational energy of the ions is enhanced by increasing the confining magnetic field with time, as for example, by compressing the liner 36 which compresses the magnetic flux.

After compression, the second gate coil 30 is pulsed and the coil 30 decreases the amplitude of the far mirror peak so that the ions propagate out of the magnetic mirrior. The ions then pass through the neutral gas 31 which separates the ions from any electrons that may be intermixed with the ions.

The ions propagate through a toroidal disc 40 and a half magnetic cusp. The disc 40 increases the slope of the half-cusp and the half-cusp transforms some of the rotational energy of the ions to translational energy. Thus, the ions propagate and continue to rotate. The translational and azimuthal current densities, $J_z$ and $J_\theta$, respectively, of the ions form self magnetic fields, $B_\theta$ and $B_z$, respectively. The self field, $B_z$, conserves the canonical angular momentum, while the self field, $B_\theta$, prevents the beam of ions from expanding radially. Thus, the beam continues to propagate and may be directed to a target without expanding radially and without an external applied magnetic field or a guide tube.

Obviously many more modifications and variations of the present invention are possible in light of the above teachings. It is therefore to be understood that within the scope of the appended claims the invention may be practiced otherwise than as specifically described.

What is claimed and desired to be secured by Letters Patent of the United States is:

1. A system for generating intense (high-current), high-energy ion pulses, and propagating the pulses independent from a requirement for an applied external magnetic field, guide tube, or other applied guiding means, comprising:

means for forming a magnetic field, said field having axial and radial components, and said field including a magnetic mirror having near and far mirror peaks;

means for forming a hollow beam of ions, the axis of said beam coinciding with the axis of said magnetic field, said ions having translational energy and translational velocity, $v_z$;

means for providing rotational energy and a rotational velocity, $v_\theta$, to said ions and causing the ions to rotate;

means for forming a ring of ions, inside the magnetic mirror, said ions having rotational and translational energy;

means for increasing the rotational energy of said ions;

means for extracting said ring of ions;

means for separating the ions from any electrons which may be intermixed with the ions; and means for increasing said translational energy of the ions, said extracted ions having rotational and translational energy, said ions forming rotational and translational current densities, $J_\theta$ and $J_z$, respectively, said $J_\theta$ producing a self-magnetic field, $B_z$, and said $J_z$ producing a self-magnetic field, $B_\theta$, said $J_z$ and $B_\theta$ producing an inward force, $J_z B_\theta$, for inhibiting radial expansion of the beam and maintaining equilibrium of the beam during propagation.

2. A system as recited in claim 1, wherein said means for forming the magnetic field includes magnetic coils.

3. A system as recited in claim 1, wherein said means for forming a hollow beam of ions is an inverse reflex tetrode.

4. A system as recited in claim 1, wherein said means for providing a rotational velocity, $v_\theta$, to said ions includes a first disc which sharpens a magnetic cusp along said magnetic field, said cusp causing said ions to rotate.

5. A system as recited in claim 4, wherein said first disc has a concentric, toroidal opening through which said ions propagate.

6. A system as recited in claim 5, wherein said disc is formed from a ferromagnetic material.

7. A system as recited in claim 1, wherein said means for forming a ring of ions includes a first gate coil which produces a fast-rising magnetic field gate, said gate increasing said near mirror peak such that said magnetic mirror confines the ions, the confined ions having rotational energy and forming a ring of rotating ions.

8. A system as recited in claim 1, wherein said means for increasing the rotational energy of the ions includes a metal liner surrounding said ions, said liner being compressed for compressing the magnetic flux about said ions, said flux being a constant, said compressed flux causing the magnetic field about said ions to increase, energy from the increasing magnetic field being transferred to the ions.

9. A system as recited in claim 1, wherein said means for extracting said ring of ions includes a second gate coil for decreasing the amplitude of said far mirror peak, the decreasing far mirror peak allowing the ring of ions to propagate and leave said system.

10. A system as recited in claim 1, wherein said means for separating the ions from any electrons is a neutral gas.

11. A system as recited in claim 1, wherein said means for increasing the translational energy of the ions includes a second disc which sharpens a magnetic half-cusp along said magnetic field, the ions passing through said second disc, said half-cusp allowing the ions to propagate and maintain some rotational energy during propagation.

12. A system as recited in claim 11, wherein said disc is toroidal.

13. A system as recited in claim 12, wherein said disc is formed from a ferromagnetic material.

* * * * *